US006332285B1

(12) United States Patent
Aaldenberg et al.

(10) Patent No.: US 6,332,285 B1
(45) Date of Patent: Dec. 25, 2001

(54) POSITIONABLE INDEXING TAB

(75) Inventors: Eric R. Aaldenberg, Bayside, NY (US); Lee A. Boy, Jamestown, NC (US); Michael Birch, Oakville (CA); Robert D. Seiler, Huntington; James J. Lynch, Point Lookout, both of NY (US)

(73) Assignee: Esselte Corporation, Garden City, NY (US)

( * ) Notice: Subject to any disclaimer, the term of this patent is extended or adjusted under 35 U.S.C. 154(b) by 0 days.

(21) Appl. No.: 09/343,059

(22) Filed: Jun. 29, 1999

(51) Int. Cl.[7] ..... G09F 23/10

(52) U.S. Cl. ..... 40/641; 40/359; 40/360; 40/658; 40/666; 283/36; 229/67.1; 229/67.2

(58) Field of Search ..... 40/359, 360, 641, 40/658, 666; 283/36, 37, 39, 41; 229/67.1, 67.2; 312/184

(56) References Cited

U.S. PATENT DOCUMENTS

| | | | | |
|---|---|---|---|---|
| 1,513,929 | * | 11/1924 | Rand | 40/360 |
| 2,601,026 | * | 6/1952 | Jones | 40/641 |
| 2,910,985 | * | 11/1959 | Epstein et al. | 40/651 |
| 3,062,217 | * | 11/1962 | Woodhouse, Jr. | 40/652 |
| 3,238,947 | * | 3/1966 | Churnick | 211/162 |
| 3,244,179 | * | 4/1966 | Porteous et al. | 211/162 |
| 3,438,143 | * | 4/1969 | Wolfersberger, Jr. | 40/641 |
| 3,507,063 | * | 4/1970 | Jochheim | 40/641 |
| 4,053,057 | * | 10/1977 | Snowden | 211/126.13 |
| 4,318,236 | * | 3/1982 | Giulini | 40/360 |
| 4,882,862 | * | 11/1989 | Slavsky, Sr. | 40/324 |
| 5,488,793 | * | 2/1996 | Gebka et al. | 40/661.03 |
| 5,707,001 | * | 1/1998 | Mark et al. | 229/67.2 |
| 5,863,019 | * | 1/1999 | Rose et al. | 248/205.3 |
| 5,899,011 | * | 5/1999 | Brinkman | 40/611.03 |

FOREIGN PATENT DOCUMENTS

| | | | | |
|---|---|---|---|---|
| 2541850 | * | 3/1977 | (DE) | 40/641 |
| 1138809 | * | 1/1969 | (GB) | 40/641 |

* cited by examiner

*Primary Examiner*—B. Dayoan
*Assistant Examiner*—Andrea Chop
(74) *Attorney, Agent, or Firm*—Pennie & Edmonds LLP

(57) ABSTRACT

A plastic tab for indexing or marking a folder or an edge portion of an article such as an organizer or storage system. The lower portion of the tab has two downwardly extending walls, between which an edge of the folder or other article may be placed. The downwardly extending walls are configured and adapted to create an interference fit when the folder or other article is inserted between the walls of the tab. The interference fit enables the tab to remain securely in the desired position along the edge portion. The tab is made of a flexible polymeric material so that it may be mounted, re-positioned or removed easily. Removal of the tab from a wall edge causes the walls to flex apart and thereby eliminate or minimize the interference fit between the tab lower walls and the article on which the tab is mounted. Removal of the tab is therefore a smooth and simple operation that minimizes breakage of the tab or damage to the folder, organizer or storage medium.

11 Claims, 3 Drawing Sheets

FIG. 1
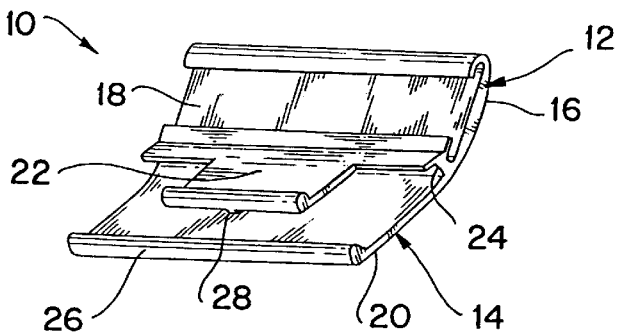
FIG. 2
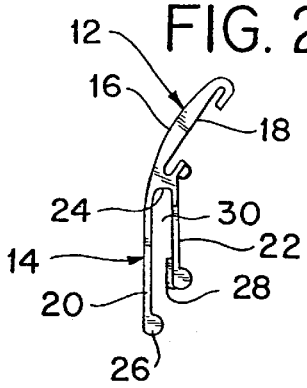
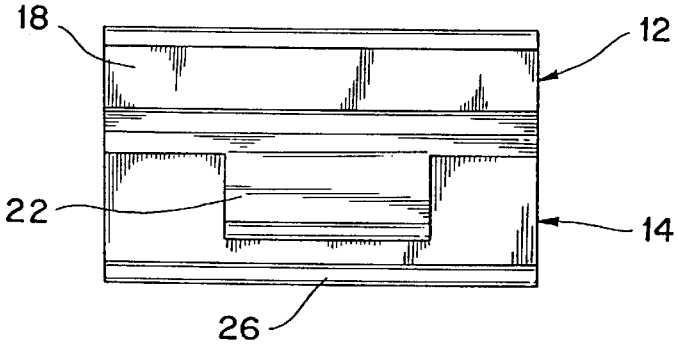
FIG. 3
FIG. 4
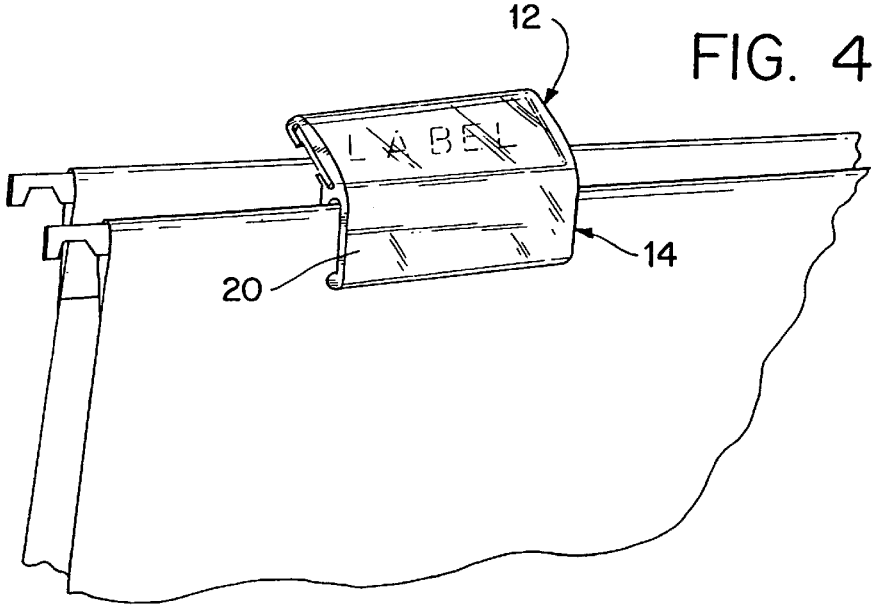

POSITIONABLE INDEXING TAB

FIELD OF THE INVENTION

The present invention relates to indexing tabs for use with organizer, storage and/or information management systems, and in particular, to a molded plastic indexing tab that is releasably positionable on a folder, file partition or other planar surface.

BACKGROUND OF THE INVENTION

Tabs that can be mounted on file folders or storage partitions for indexing, marking, cataloguing, listing or sorting purposes are well known in the art. Typically, they are made of extruded or molded plastic material and have means for attachment to an edge of a partition or a paper or plastic sheet. They are typically designed to be removable so that they can be repositioned or taken off entirely. For example, a variety of tabs are designed for use with hanging file folders. These folders typically have metal support bars attached at their upper edges, and tabs are often mounted along the upper edge of such a folder. Such tabs are generally provided with means at or near their lower edges for engaging the folder top edge and/or the support bar. The folder edge often has holes or slots into which the tab or some portion thereof fits so that an indexing portion of the tab projects beyond the edge of the folder.

Ideally, it should be relatively easy for a user to mount or reposition an indexing or marking tab on a folder or partition, but the tab should also remain securely in place once it is mounted. It should likewise be easy to remove the tab without damaging it or the surface on which it has been mounted. The amounts of effort and dexterity needed to mount or remove a tab should be minimal. Prior art tabs often fail to meet these criteria, for various reasons.

It is known in the art of hanging file folders, for example, to use a stiff plastic tab for clamping or clipping onto the top edge of the folder. Such tabs commonly have a front portion, on which indexing or labeling information can be written or attached, and a rear portion, which forms the reverse or back of the tab. Typically, such tabs are molded and have two prongs extending downwardly from, for example, the front of the tab at the edges thereof. A third prong may extend downwardly from the central portion of, for example, the rear of the tab, thus forming a clip configuration, whereby the first two prongs press against one face of the folder edge, and the third prong grips the opposite face of the folder edge. The means by which such a tab grips the folder edge are two-fold: first, the three prongs exert a squeezing force on the folder edge in a manner similar to that exerted by a paper clip that is clipped to the edge of a piece of paper. Second, the tab is provided with one or more protuberances on the third prong configured and adapted for insertion into corresponding regularly-spaced holes in the folder's upper edge and/or in the support bar. When one such protuberance is molded into the tab's third prong, it is typically centrally located on the face of the prong that presses against the folder edge. The single protuberance is inserted into a hole in the folder edge and/or the support bar to create an interlocking fit therebetween. In prior art tabs having two protuberances on the third prong, the protuberances are spaced apart from each other so that they engage adjacent holes in the folder edge and/or in the support bar.

Engagement of the protuberance(s) with the holes in the folder edge and/or the support bar ensures that the tab will not move out of position once it is mounted, but this arrangement also makes it difficult to remove the tab, because it resists being pulled or twisted out of engagement with the folder and/or in the support bar holes. Attempts to remove or re-position this kind of tab easily result in tearing the file folder, which is typically made of paper. When an attempt is made to remove the tab by bending it and pulling it off the folder, for example, the tight fit between the tab and the folder tends to cause friction and wear along the top edge of the folder and in the holes or slots from which the tab is being removed. Removing such a tab also can easily cause one of its protuberances to break off, thus rendering the damaged tab virtually useless. Also, tabs with such protuberances are limited in that they must be used with file folders having the appropriate configuration of regularly spaced holes, and because positioning of the tab is restricted to the predetermined placement of the holes.

Some indexing tabs known in the art are made of extruded plastic. Such tabs typically engage the top edge of the folder by exerting pressure thereupon with downwardly extending legs that may be angled inwardly toward one another to provide one or more contact points for gripping the folder. The cross-section of an extruded tab is limited by the fact that the extrusion process produces a profile with a constant cross-section. Therefore, extruded tabs are not produced with protuberances such as those described above on molded tabs. Instead, it is typical for the downwardly extending legs to exert pressure against the folder along the entire width of the extruded tab. Sufficient clamping pressure must be exerted to prevent the tab from being knocked out of position or accidentally pulled off the folder. To provide sufficiently high clamping pressure, the tab is typically formed of relatively inflexible plastic, and the downwardly extending legs are typically angled toward each other so that they are able to squeeze a folder edge that is inserted between them. The rigidity of the plastic tab, combined with the orientation of the downwardly extending legs toward each other, enable a tight fit to be achieved between the tab legs and the folder; therefore, the tab tends to stay where it is mounted. Because it is so inflexible, however, it is difficult and awkward to mount, remove or reposition the tab. A user must exert a fair amount of force to push the tab onto a folder or to yank it off. Because the tab does not bend easily, it tends to cause friction and wear on the folder when the user applies or removes the tab, with the result that the folder is often ripped, frayed or bent. Furthermore, the tab itself is easily damaged, because the relatively inflexible downwardly extending legs tend to crack or snap off easily when force is applied to them. Thus, instead of being reusable or re-positionable, the tab often is thrown away after only one use, because it breaks so easily.

Therefore, there exists a need for a tab that can be mounted on, repositioned along and removed from a folder or partition with smooth, uncomplicated motions, wherein damage to the tab and the folder is minimized during such operations. These objects are all fulfilled by the positionable indexing tab of the present invention.

SUMMARY OF THE INVENTION

The present invention is directed to a plastic tab for indexing or marking a folder, a partition or other planar surface used in an organizer or storage system. The tab has an upper portion and a lower portion formed integral with the upper portion, and the upper portion is adapted for displaying indicia that relate to or describe materials that are within the organizer or storage system. The tab's lower portion comprises a front wall and an opposed rear wall, both of which are configured and adapted for gripping an edge portion of the folder or organizer or storage medium with an interference fit. The tab may be positioned at substantially any location along the edge portion of the folder or organizer or storage medium, i.e., its placement is not limited to locations in alignment with the holes or slots typically formed in the upper edges and/or the support bar of, e.g., a hanging file folder, because the tab's lower portion is adapted to hold the tab securely in position while also allowing the tab to be released when a user removes or re-positions it. The front wall and rear wall of the tab are formed of a material that is sufficiently flexible, so that when pressure is applied to one of the walls, it flexes away from the other opposed wall. This flexibility enables the tab to be released easily by a user who wishes to remove or reposition the tab.

A detent may be molded integrally on an inner surface of either the front or rear wall of the tab in order to produce an interference fit between the tab and the article on which it is mounted. Preferably, the detent is molded in a central position on the rear wall and is disposed inwardly, i.e., toward the front wall, but the detent may be located elsewhere, such as on the front wall, or more than one detent may be situated on the tab. The rear wall is much smaller than the front wall in the preferred embodiment, although a variety of different sizes and shapes for the lower portion of the front and rear walls are contemplated.

Preferably, the tab is formed from a polymeric material such as a thermoplastic polymer. The most preferred such material is clarified polypropylene. This material adds flexibility to the tab, so that at least one of the lower walls can bend away from the other while a force is applied to mount or remove the tab on or from a folder or other article used for organizing, indexing, cataloguing, storing or sorting purposes.

A track may be formed between the front wall and the rear wall of the lower tab portion and configured and adapted to receive an edge portion of the organizer or storage medium. When the track is seated on the edge portion, any tendency of the tab to rotate with respect to such edge portion is minimized.

The tab may also be provided with a ridge, preferably located along a lower edge of the tab's front wall. The ridge extends at least partially along the lower edge, and it tends to enhance the interference fit between the tab and the folder or other article on which it is mounted. Although a single ridge is described herein for the most preferred embodiment, it is equally possible to locate multiple ridges or bulges on an inwardly facing lower wall in order to accomplish the desired interference fit. In the most preferred embodiment, a single ridge extends across substantially the entire width of the lower edge of the front wall. The ridge may be used with or without the detent described above to provide an interference fit that prevents the tab from sliding or falling off the article on which it is mounted. Because the lower walls are flexible, removing or repositioning the tab is smoothly and easily accomplished through the use of a pulling force that causes at least one of the lower walls to bend away from the other.

In a further embodiment, the tab is provided with release means comprising, preferably a release lever that is formed integral with the rear wall. The release lever extends outwardly, i.e., away from the tab, preferably from a central portion at the rear of the tab. When the release lever is grasped and squeezed toward the tab upper portion, the resulting squeezing force reduces or eliminates the interference fit that otherwise exists between the lower tab walls and the article on which the tab is mounted. The squeezing force causes at least a portion of the rear wall to bend away from the front wall. A gap between the front wall and the rear wall is widened when one wall bends away from the other, thus permitting the tab to be installed easily upon or, alternatively, withdrawn easily from the edge portion of the organizer or storage medium.

Another embodiment of the tab also includes a release lever or releasing means for spreading apart the lower walls of the tab, as described above, but this embodiment has no detent for providing the interference fit between the lower walls of the tab and the edge of the article on which it is mounted. Rather, both the lower front wall and the lower rear wall of this embodiment are provided with ridges along their lower edges. These ridges grip the article on which the tab is mounted with an interference fit that securely retains the tab on the article. Yet, because the tab is formed of a flexible material, the lower walls may be spread apart by squeezing the release lever toward the upper portion of the tab. Thus, because the tab is flexible, it may be mounted, removed or repositioned with ease.

The tab may optionally be provided with stop means that prohibit the release lever from being moved rotationally toward the tab upper portion beyond a predetermined distance. When the release lever is rotated through the predetermined distance, the lower walls spread apart by an amount sufficient to release the tab's grip on the article on which it has been mounted. Removal or repositioning of the tab can therefore be accomplished without causing friction, wear or other damage to the article. Thus, this embodiment of the invention provides a plastic tab configured and adapted for mounting at substantially any location along an edge portion of an organizer or a storage medium. This embodiment includes a release lever formed integral with the rear wall, wherein the release lever is configured and adapted, when moved toward the tab upper portion, to cause at least a portion of the rear wall to bend away from the front wall to facilitate mounting, repositioning, and removal of the tab. The tab upper portion further comprises stop means for prohibiting rotational movement of the release lever toward the tab upper portion beyond a predetermined distance.

In an embodiment in which the tab is adapted for use with, e.g., hanging file folders, the upper portion of the tab may be canted at an angle for ease of visibility of the indexing or marking label that may be inserted or applied thereon. Accordingly, in a preferred embodiment, the upper tab portion has a substantially C-shaped cross section. Indicia such as a label may be inserted from either side of the tab. An alternative embodiment uses a hinged indexing portion that can be snapped closed or pulled open with a fingertip, wherein a living hinge is molded into the upper, indexing portion to facilitate opening and closing of the tab upper portion.

BRIEF DESCRIPTION OF THE DRAWINGS

FIG. 1 is a rear perspective view of a first embodiment of the tab of the invention;

FIG. 2 is a side view of the tab shown in FIG. 1;

FIG. 3 is a rear elevational view of the tab shown in FIG. 1;

FIG. 4 is a perspective view of the tab shown in FIG. 1 when mounted on a hanging file folder;

DETAILED DESCRIPTION OF THE PREFERRED EMBODIMENTS

Figure 5:
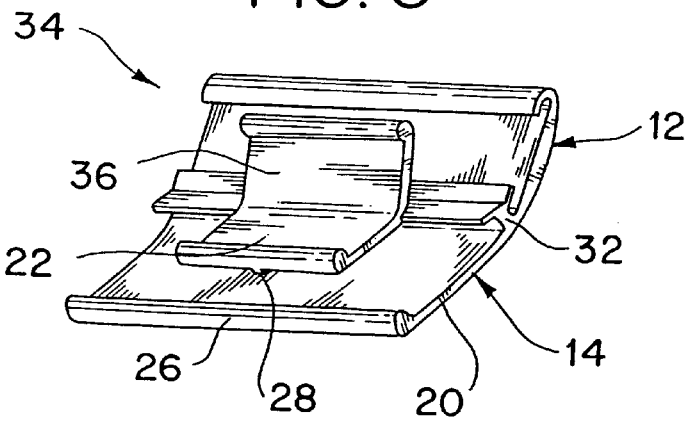
FIG. 5 is a rear perspective view of a second embodiment of the tab of the invention, showing a release lever.

FIG. 1 illustrates a first embodiment of tab 10 of the invention. For the sake of clarity, the portion of the tab facing the viewer in FIG. 1 is referred to herein as the rear of the tab, while the tab portion that faces into the page, away from the viewer, is described as the front of the tab, i.e., that portion which is most readily seen by the viewer when the tab is installed upon, e.g., a hanging file folder. Furthermore, the portion of tab 10 that is adapted for insertion of an indexing card or other indicating or labeling means, i.e., identified as 12, is referred to herein as the tab upper portion because the tab is typically, but not always, used in a vertical orientation with upper portion 12 higher vertically than the remainder of the tab, which is referred to herein as lower tab portion 14. Lower tab portion 14, formed integral with upper portion 12, is adapted for gripping an edge of an organizer or storage medium, such as, for example: a hanging file folder; a folder or cover used for organizing or binding materials such as paper, cardboard or other sheet-like media; an edge or partition in or on or in front of a binder, book, shelf, drawer, box, or other like means for cataloguing, organizing, arranging, sorting or storing paper, photographs, recorded media, inventory, small objects, and the like in a manner which permits rapid and easy insertion and removal without significant danger of damage to the tab or the item to which it is mounted.

As also illustrated in FIG. 2, upper tab portion 12 is preferably (although not necessarily) provided with a C-shaped cross-section adapted for receiving and displaying an indexing card or label (not shown), which may be inserted from either end of the tab and viewed through the clear front face 16. The label may be positioned with finger pressure against back 18 of tab 10. Lower portion 14 of tab 10 includes downwardly extending front wall 20 and rear wall 22. As used herein, the term "downwardly" means in a direction substantially parallel to, but away from, the tab upper portion. In a preferred embodiment, rear wall 22 is shorter and not as wide as front wall 20, as illustrated in FIGS. 1 and 3. A track 24 extends across the width of the tab, as shown in FIGS. 1 and 2, for receiving the edge of the object on which the tab may be mounted, for example, the upper edge of a hanging file folder. Front wall 20 has a ridge 26 across its bottom edge for resting or pressing against a flat portion or wall of the object on which the tab may be mounted. Rear wall 22 has a detent 28, preferably centrally located at the lower edge and directed toward the gap 30 (see FIG. 2) between front and rear walls 20, 22. Detent 28, as explained more fully below, is sized and positioned to create an interference fit among itself, the opposing lower front wall 20 of the tab and the edge of the object that is inserted therebetween. Detent 28 is not, however, primarily adapted for insertion through or into the holes in the folder edge and/or in the support bar as in the prior art tabs described above and will create the requisite tension fit whether or not it is inserted into one of the holes.

The tab of FIG. 1 is suitable for mounting on an edge any of a variety of storage, cataloguing, sorting or organizing media, as noted above. However, for the sake of convenience, the tab will be described herein as if it were being used as an indexing tab for a hanging file folder, it being understood that numerous additional uses, such as those described above, for example, would readily suggest themselves to one of ordinary skill in the art.

Commercially available hanging folders typically have a metal support rod extending across each top edge, with hooks or notches at the ends of each rod to enable the folder to hang on a standard file frame. Many folders are also provided with holes or indentations in the rods and/or in the paper or plastic folder body material that covers the support rods. Other hanging folders may not have such a support rod across the top of each edge. The tab of the invention is thus adapted to operate equally well with either construction.

When the tab of the invention is mounted on a hanging folder, it is typically mounted on the upper edge of either a front folder wall or a rear folder wall, as illustrated in FIG. 4. Each folder wall has an outer face that faces outside the folder and an inner face that faces the inside of the folder. When tab 10 is mounted on the front wall of the folder, for example, gap 30 between front and rear walls 20 and 22 of tab lower portion 14 receives the upper edge of the folder in that the edge touches track 24, front wall 20 touches the front 35 face of the folder wall, and rear wall 22 touches the rear face of the folder wall. Track 24 preferably extends all the way across the width of tab 10 to stabilize the vertical orientation of the tab, i.e., to prevent it from tilting with respect to the folder, although it is envisioned that the track may extend less than all the way across the width or may be configured as two or more discrete track sections for receiving an edge of, for example, a folder.

Detent 28, when present, presses against the upper portion of the folder with an interference fit that enables tab 10 to maintain its position at any desired location along the upper edge of the folder. If tab 10 is mounted on the front wall of the folder, detent 28 presses into the rear face of the folder edge material, which is typically paper, cardboard, plastic, or a laminated combination of these materials. On the front or opposite face of the folder edge, the tab's front wall 20 exerts a light clamping force through ridge 26. In the preferred embodiment, ridge 26 and detent 28 face each other but are offset slightly in height, as shown FIG. 2. This configuration enables a sheet or partition placed therebetween to be gripped with a secure interference fit, which is sufficient to enable tab 10 to remain securely on the edge of, for example, the folder.

The tab of the invention may thus be mounted at any desired location along the upper edge of, for example, a hanging folder, because it attaches with an interference fit that is not dependent upon a particular edge configuration of the object on which the tab is mounted. For example, if tab 10 is mounted on a hanging file folder, the folder is not required to have holes, slots or other means that are typically needed for mounting prior art indexing tabs. If the folder has such holes or slots, the detent may, if desired, be placed therein, but such is not required for proper tab operation and thus the holes or slots do not interfere with the use of the tab. That is, the tab may be mounted at any location along the folder upper edge, without regard to the placement of such holes or slots, since mounting and securing the tab primarily occurs due to a press fit with the folder top edge, rather than entry of the detent into a hole or slot in the tab or the support rod. Tab 10 may also be mounted on a hanging folder whether or not a support rod is located at or near the upper edge. If a support rod does extend across the upper edge, tab 10 is normally mounted with an interference fit between detent 28 and the folder body, preferably immediately below the support rod. The tab of the invention is therefore exceedingly versatile in that it may be mounted on a wide variety of organizing or storage media that are not necessarily designed for use with one specific kind of indexing tab.

To remove or reposition tab 10, a user grasps upper portion 12 and pulls it straight up or rotates it forward out of the plane of the folder wall. Rotating the tab causes its lower walls 20 and 22 to flex apart, thereby releasing the grip of detent 28 on the folder body. While the lower tab walls are thus deformed, tab 10 may easily be repositioned elsewhere along the folder's edge or pulled off completely. When the user releases his or her grip, the lower walls 20 and 22 flex back towards each other and tab 10 is thus ready for storage or reapplication to another folder or to another portion of the same folder.

Tab 10 is preferably formed of a thermoplastic polymer. The most preferred polymer material is clarified polypropylene, which offers the advantages of being transparent, relatively flexible and easily moldable. This material therefore provides a unique advantage in that it permits formation of tabs which are substantially more flexible than the prior art extruded tabs described above. This added flexibility facilitates the reciprocal motion of the tab walls when pressure is applied thereto and then released, thus permitting the tab to be readily slipped on or off the folder edge without cracking or snapping one of the walls, i.e., a significant problem with prior art extruded tabs. Thus the enhanced flexibility of the material used in forming the tab enables lower walls 20 and 22 to bend apart when, for example, the upper portion 12 of tab 10 is pulled forward to release the tab from the top of a hanging file folder. This characteristic of the tab reduces the likelihood that the tab will crack or that the folder body or partition will be marred or ripped when the tab is mounted or moved. The tab's flexibility also contributes to the simplicity and smoothness of the motions that are used to manipulate the tab.

Figure 6:
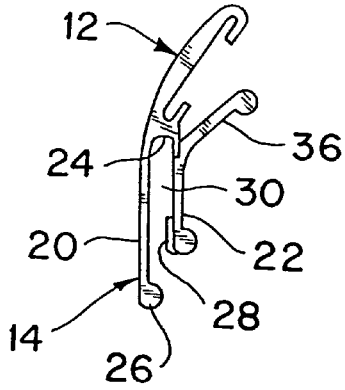
FIG. 6 is a side view of the tab shown in FIG. 5.

A second embodiment of the tab of the invention is illustrated in FIGS. 5 and 6. Tab 34 includes many of the same features as tab 10, but differs in that it is additionally provided with a release lever 36 extending upwardly from rear wall 22, as illustrated in FIGS. 5 and 6. The release lever 36 provides an alternate means for spreading the lower walls 20 and 22 apart from each other, and thus is useful in mounting, removing and re-positioning tab 34. To use the release lever, a user merely grips lever 36 and squeezes it toward the upper portion 12 of tab 34. The squeezing force causes the mid-section 32 of the tab to act as a fulcrum so that rear wall 22 swings away from front wall 20. When a user removes the tab from its position on a folder edge, the act of squeezing the release lever against the upper portion causes the detent 28 to move away from the folder body and makes removal a simple, fluid motion. Once the squeezing force is eliminated, lower walls 20 and 22 spring back to their unstressed alignment. Tab 34 is also preferably formed of a thermoplastic polymer such as clarified polypropylene.

Figure 7:
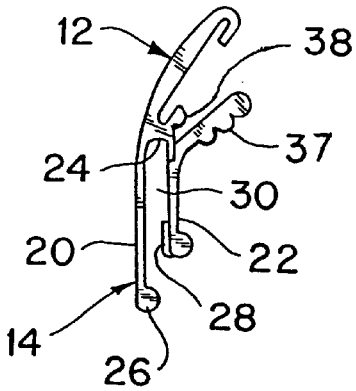
FIG. 7 is a side view of a third embodiment of the tab of the invention.

A third embodiment of the invention, illustrated in FIG. 7, is similar in most respects to that shown in FIGS. 5–6 in that it includes release lever 37, which is squeezed toward upper portion 12 to allow lower walls 20 and 22 to spread apart from each other, in a similar manner to that described above. Release lever 37 as shown in FIG. 7 moves in a counter clockwise direction when it is being squeezed toward upper portion 12. As release lever 37 moves closer to upper portion 12, lower walls 20 and 22 pivot away from each other and gap 30 between lower walls 20 and 22 becomes wider. When gap 30 widens, it enables the tab to be mounted and/or removed easily. When a sufficient squeezing force or pressure is applied to release lever 37 and upper portion 12 to separate lower walls 20 and 22 sufficiently to permit mounting or removal of the tab, release lever 37 touches stop means 38, which is preferably a thickened or otherwise enlarged projection on tab upper portion 12 and which prevents further counter clockwise movement of lever 37. Thus, stop 38 allows lower walls 20 and 22 to pivot away from each other by a predetermined amount of deflection, i.e., only as much as is necessary to move the tab onto or off of the folder. This is additionally important in that the material from which the tab of the invention is preferably formed retains a certain amount of "memory" (as that term is used in the art) with regard to, e.g., squeezing stresses applied to the tab in order to spread the legs of the bottom portion apart. Thus, in the absence of the stop means, an excessive pressure applied to the tab may cause the tab legs to remain spread open and thus unable to effectively grip the folder edge properly.

A further advantage of release lever 37, with or without stop 38, is that it prevents tab 34 from rubbing against and thus causing friction and/or wear to the folder body. Instead of rubbing against the folder edge during placement or removal, and thereby causing ripping, tearing or other wear, the lower walls 20 and 22 are deflected away from each other with lever 37, thus permitting smooth, non-destructive positioning of the tab. Thus, there is essentially no wear on the folder body during mounting or removal, because the act of squeezing lever 37 causes stresses to be concentrated within the tab instead of on the folder body. For example, in an application where tab 34 is mounted on a hanging folder body having holes or slots (as described above) near the upper edges, detent 28 may happen to be inserted in one of the slots. To remove the tab from the folder, the user squeezes release lever 35 toward upper portion 12 until stop 38 prevents release lever 37 from moving closer to upper portion 12. The squeezing action causes lower walls 20 and 22 to move apart from each other so that the tab of FIG. 7 releases its grip upon the folder and comes off easily. Detent 28 is capable of sliding out of the slot in the folder without imparting potentially-destructive stresses on the slot. Thus, the tab is adapted and configured to be removable, even if it is used on a folder having slots, without risking wear and tear on the folder in the vicinity of the slots. Because such damage is greatly minimized or obviated, the tab and folder may be reused many times, without degradation of the tab and folder materials or the tight grip therebetween.

Figure 8:
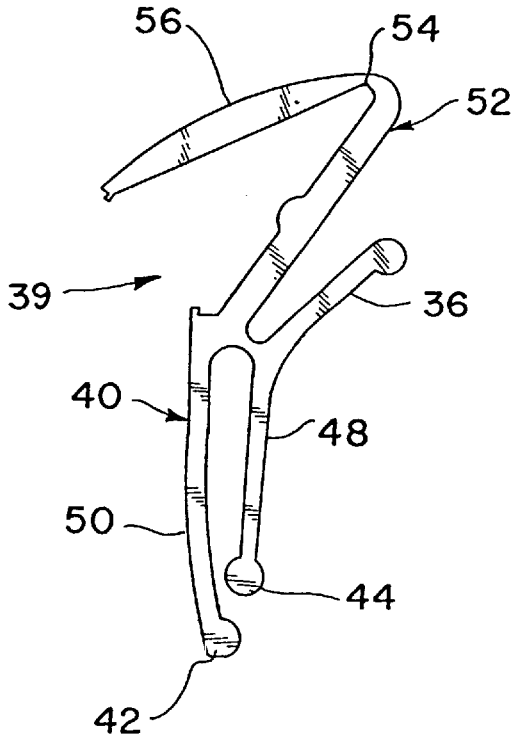
FIG. 8 is a side view of a fourth embodiment of the tab of the invention.
Figure 9:
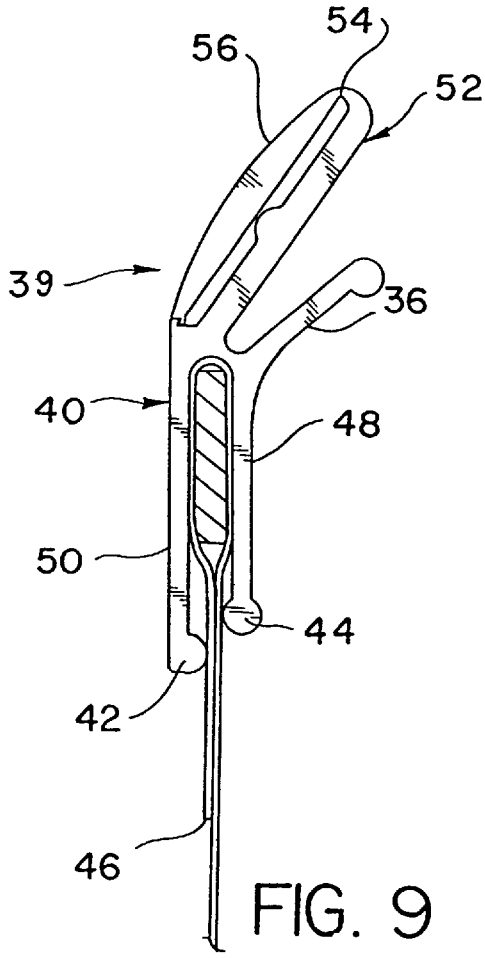
FIG. 9 is a side view of the tab shown in FIG. 8.

FIGS. 8 and 9 illustrate a fourth embodiment of the invention, referred to herein for identification as tab 39. Tab 39 has no detent for achieving an interference fit between the lower portion 40 of the tab and the article on which the tab is mounted. In place of such a detent, tab 39 is provided with front wall ridge 42 and rear wall ridge 44 adapted for gripping an article 46 such as a folder edge, wherein ridges 42 and 44 are substantially parallel to each other. The interference caused by the squeezing action of the ridges 42 and 44 on article 46 gives a secure fit that prevents tab 39 from sliding out of position or falling off the edge of article 46. Tab 39 includes release lever 36 that may be squeezed, as in the second embodiment described above, to cause rear wall 48 to pivot away from front wall 50 and thus disengage the tab from the article on which it is mounted. Release lever 36 may be used with or without tab stop means 38 described above.

Tab 39 is provided with an upper portion with a configuration that differs from that of the other embodiments. That is, upper tab portion 52 is provided with a hinged section for receiving an indexing or marking label. Living hinge 54, shown in FIGS. 8 and 9, enables front upper face 56 to swing down and snap into the closed position shown in FIG. 9 after the label has been inserted (label not shown). Alternatively, upper portion 52 may be adapted to receive an adhesive label or direct application of ink for marking purposes. Tab 39 also achieves a secure hold and can be easily removed from or repositioned along an edge portion of a variety of organizing, sorting or storage articles. Tab 39 is also preferably formed of, e.g., clarified polypropylene.

It is further envisioned that the tab of the invention may be formed without a ridge 26 or 42 on lower front wall 20 or 50, or the ridge may be placed elsewhere on the front wall in one or more sections or as a different shape such as one or more convex regions. Also, the front and rear walls do not have to be rectangular panels as illustrated but may assume a variety of shapes, including for example a rear wall shape that may be provided with a plurality of detents. Still further, although front wall 20 or 50 is illustrated in the figures as extending downwardly farther than rear wall 22 or 48, respectively, this configuration may be reversed, or the walls may be made of equal length. Detent 28 may alternatively be located on the rear face of front wall 20, and ridge 26 may be located on the front face of rear wall 22. It is particularly envisioned, furthermore, that the tab of the invention will not be limited for use on a hanging file folder, but that it also may be used for marking or indexing various other media, from paper or plastic folders, to merchandise display partitions or shelves, to drawers and storage boxes used for organizing inventory, household items, and the like.

It should be understood that variations and modifications within the spirit and scope of the invention, beyond those discussed herein, may occur to those skilled in the art to which the invention pertains. Accordingly, all expedient modifications readily attainable by one versed in the art from the disclosure set forth herein are to be included as further embodiments of the present invention. The scope of the present invention accordingly is defined as set forth in the appended claims.

What is claimed is:

1. A tab adapted for mounting on an edge portion of a wall member of an organizer or a storage medium, said tab comprising:

an upper portion and a lower portion formed integral with said upper portion, said upper portion configured and adapted for displaying indicia therein relating to materials within said organizer or storage medium, wherein said lower portion comprises a front wall and a substantially parallel, opposed rear wall, said front and rear walls configured for defining a cavity for receiving and gripping the edge portion of the wall member of the organizer or storage medium in the cavity between said front wall and said rear wall, with the front and rear walls having bottom edges that include ridges having a thickness greater than that of the walls for creating an interference fit with the edge portion of the wall member of the organizer or storage medium, wherein said lower portion is adapted for releasably positioning said tab at substantially any location along said edge portion, and wherein said front wall and rear wall are formed of a thermoplastic polymer that is sufficiently flexible such that, when pressure is applied to one of the two said opposing walls, the pressed wall flexes away from the opposing wall to release the interference fit and enable the tab to be removed from the wall member or repositioned at a desired location along said edge portion, and wherein a detent is molded integrally on an inner surface of one of said walls.

2. The tab of claim 1, wherein said thermoplastic polymer is clarified polypropylene.

3. The tab of claim 1, wherein the detent is molded upon said rear wall.

4. The tab of claim 1, further comprising a track formed between the front wall and the rear wall, said track adapted for receiving an edge portion of the organizer or storage medium.

5. The tab of claim 1, wherein the tab upper portion has a cross-section that is substantially C-shaped to facilitate insertion and retaining of said indicia.

6. The tab of claim 1, further comprising a release lever formed integral with said rear wall, said release lever configured and adapted, when moved toward said tab upper portion, to cause at least a portion of the rear wall to bend away from the front wall to facilitate mounting, repositioning, and removal of said tab.

7. The tab of claim 6, wherein the tab upper portion further comprises stop means for prohibiting rotational movement of said release lever toward said tab upper portion beyond a predetermined distance.

8. The tab of claim 1, wherein the tab upper portion comprises a front face and a living hinge pivotably connecting said front face to said upper portion said living hinge adapted to permit rotation of said front face between a closed position and an open position to facilitate insertion and removal of the indicia from said tab.

9. The tab of claim 1 in combination with a hanging file folder.

10. A tab adapted for mounting on an edge portion of a wall member of an organizer or a storage medium, said tab consisting of:

an upper portion and a lower portion formed integral with said upper portion, said upper portion configured and adapted for displaying indicia therein relating to materials within said organizer or storage medium; and said lower portion comprising a front wall and a substantially parallel, opposed rear wall, said front and rear walls configured for defining a cavity for receiving and gripping the edge portion of the wall member of the organizer or storage medium in the cavity between said front wall and said rear wall, with the front and rear walls having bottom edges that include ridges having a thickness greater than that of the walls for creating an interference fit with the edge portion of the wall member of the organizer or storage medium, wherein said tab lower portion is adapted for releasably positioning said tab at substantially any location along said edge portion, and wherein said front wall and rear wall are formed of a thermoplastic polymer that is sufficiently flexible such that, when pressure is applied to one of the two said opposing walls, the pressed wall flexes away from the opposing wall to release the interference fit and enable the tab to be removed from the wall member or repositioned at a desired location along said edge portion, and wherein a detent is molded integrally on an inner surface of one of said walls.

11. The tab of claim 10, wherein the detent is molded upon said rear wall.

* * * * *